US007914220B2

(12) United States Patent
Neuner et al.

(10) Patent No.: US 7,914,220 B2
(45) Date of Patent: Mar. 29, 2011

(54) VENTED MASCARA WIPER

(75) Inventors: Charles P. Neuner, Amityville, NY (US); William Bickford, Northport, NY (US)

(73) Assignee: ELC Management LLC, New York, NY (US)

( * ) Notice: Subject to any disclaimer, the term of this patent is extended or adjusted under 35 U.S.C. 154(b) by 1346 days.

(21) Appl. No.: 11/068,704

(22) Filed: Mar. 1, 2005

(65) Prior Publication Data

US 2006/0198689 A1 Sep. 7, 2006

(51) Int. Cl.
*A46B 17/08* (2006.01)

(52) U.S. Cl. ..... 401/122

(58) Field of Classification Search ..... 401/21–122
See application file for complete search history.

(56) References Cited

U.S. PATENT DOCUMENTS 4,390,298 A * 6/1983 Carluccio ..... 401/122
5,697,720 A * 12/1997 Lhuisset ..... 401/122
5,803,638 A * 9/1998 Gueret ..... 401/122

* cited by examiner

*Primary Examiner* — Huyen Le
(74) *Attorney, Agent, or Firm* — Peter Giancana

(57) ABSTRACT

A vented wiper for a mascara bottle or other packaging and modified filling methods for containers that have vented wipers. During filling of a container, the vented wiper allows air to vent from the container, other than through the interior of the wiper.

19 Claims, 4 Drawing Sheets

VENTED MASCARA WIPER

FIELD OF THE INVENTION

The present invention pertains to wipers for mascara containers or other packaging and more particularly to wipers that allow air to vent from the mascara container other than through the interior of the wiper, during filling of the container.

BACKGROUND OF THE INVENTION

Mascara packaging commonly comprises a container in the form of a cylindrical bottle having a neck with threaded finish. The neck has an orifice through which the bottle is filled and through which a brush-rod assembly is inserted. The brush rod-assembly depends from a threaded closure that fits onto the threaded neck finish. Furthermore, typical mascara packaging comprises a wiper situated in the orifice of the neck. The purpose of the wiper, as is well known in the art, is to clean the rod as it is withdrawn from the filled bottle by a consumer, remove excess mascara from the brush and smooth out the mascara on the brush prior to application to the eyelashes.

A typical prior art wiper is shown in FIGS. 1 and 2. Broadly defined, the wiper (100) is a hollow cylinder. Notably, the typical wiper has one retention bead (101). When the wiper is fully seated on a mascara bottle, the bead fits into a complimentary groove located on an inner wall of the bottle neck. The bead and groove stabilize the wiper in the bottle neck by opposing any movement of the wiper, as for example, when the brush passes through the wiper. A lower section (102) of the wiper is tapered such that it has a smaller diameter than that of an upper section (103) of the wiper. The lower section terminates in an lower orifice (105) and the upper section terminates in a upper orifice (104). As commonly practiced, the lower orifice diameter is typically between 0.139 and 0.163 inches, although other sizes may be in use. This range accommodates most of the brush-rod applicator assemblies currently in use.

Helpful in appreciating the present invention is an understanding of a conventional mascara filling operation in a manufacturing environment.

A packaging supplier may provide mascara bottles to a filler with the wiper already fully seated in the neck and the retention bead (101) located in the complimentary groove of the neck. This saves the filler the time and effort of having to assemble those components before filling. Most fillers opt to have the supplier insert the wipers because inserting thousands of wipers requires costly wiper-insertion equipment, requires maintenance of that equipment and the cost of any damaged components that result from machine or operator malfunction must be borne by the filler. Alternatively, the wiper and bottle may be assembled at the filling site, which saves for the filler, the cost that the supplier would charge for this service, but again this is not usually done.

In either case, with the wiper (100) fully seated in the bottle neck, a flange (106) of the wiper rests on the top of the neck. In this position, the outer surface of the upper section (103) is in substantial contact with the inner wall of the neck, all around the circumference of the upper section. This contact and the contact between the retention bead (101) and complimentary groove create an airtight seal between the wiper and the neck. Generally, the airtight seal is perfect, that is, uninterrupted all around the circumference of the upper section. However, even if the airtight seal is only nearly perfect, the airtight seal may be effective enough to hinder the movement of air between the wiper and neck. With the bottle and wiper in this configuration, a product filling tube is inserted through the upper orifice (104), down to and through the lower orifice (105) of the wiper. After the bottle is filled, the filling tube is removed.

The external diameter of the filling tube is sized to leave about 0.005 inches clearance between the fill tube and the circumference of the lower orifice (105) of the wiper (100). As noted, the wiper lower orifice diameter is typically between 0.139 and 0.163 inches, which means that the outer diameter of the filling tube is typically 0.129-0.153 inches. The 0.005 inch clearance is required so that air can escape from the bottle during filling. It is to be noted that air must escape through the wiper via the lower orifice and cannot escape between the wiper and the neck of the bottle due to the perfect or near-perfect airtight seal. Given that the wall of the filling tube may typically be 0.005 inches thick, a typical filling tube orifice may be taken to be 0.119-0.143 inches in diameter. This corresponds to a cross sectional area through which a highly viscous, tacky mascara must be forced during filling. For laminar flow of a viscous fluid, the resistance to flow in a tube is inversely proportional to the fourth power of the radius of the tube. Therefore, the smaller the fill tube radius, the more difficult and costly it is to fill a mascara bottle because higher filling pressures are needed to overcome the resistance to flow and force the mascara through the fill tube. Higher filling pressure means greater energy consumption, increased safety concerns in the manufacturing environment and a greater chance of blowing the wiper out of the bottle, causing line delays. Other disadvantages to using a smaller fill tube may be obvious to those skilled in the art. Conversely, if the fill tube orifice could be made larger, then the pressure and energy required to fill mascara bottles would decrease, while the speed and safety with which bottles may be filled would increase.

OBJECTS OF THE INVENTION

A main object of the present invention is to provide a modified wiper that reduces the cost of filling mascara bottles.

Another object is to provide a wiper that increases the filling line speed of mascara bottles.

Another object is to provide a wiper that reduces the pressure required to fill a mascara bottle and reduces the energy consumed.

Other advantages of the present invention may be apparent to those skilled in the art.

SUMMARY OF THE INVENTION

The present invention is a vented wiper for a mascara bottle. The starting point may be taken to be a wiper as described in the prior art, but advantageously modified to possess one or more means for allowing air to move from the inside to the outside of the mascara bottle during a modified filling procedure.

DETAILED DESCRIPTION OF THE INVENTION

Throughout this specification, the terms "comprise," "comprises," "comprising" and the like, shall consistently mean that a collection of objects is not limited to those objects specifically recited.

Figure 1:
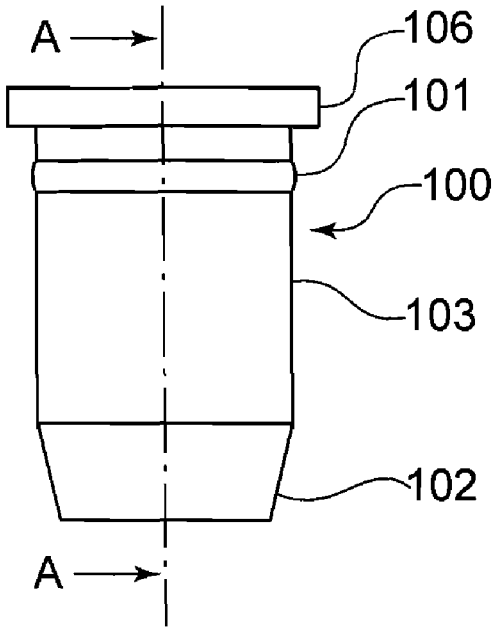
FIG. 1 (Prior Art)
FIG. 1 is a typical prior art wiper.
Figure 2:
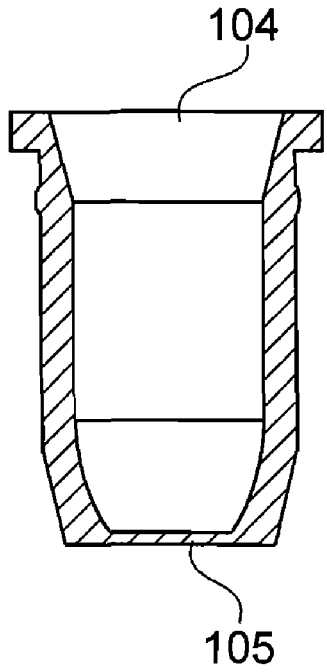
FIG. 2 (Prior Art)
FIG. 2 is a cross section through line A-A of FIG. 1.
Figure 3:
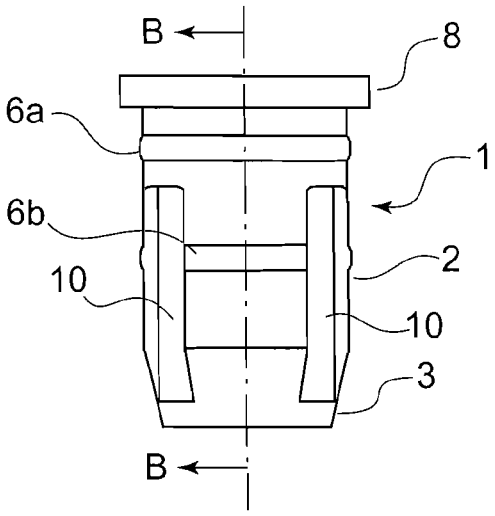
FIG. 3 is an elevation view of one non-limiting embodiment of a sealed wiper according to the present invention, having recessed venting means.
Figure 4:
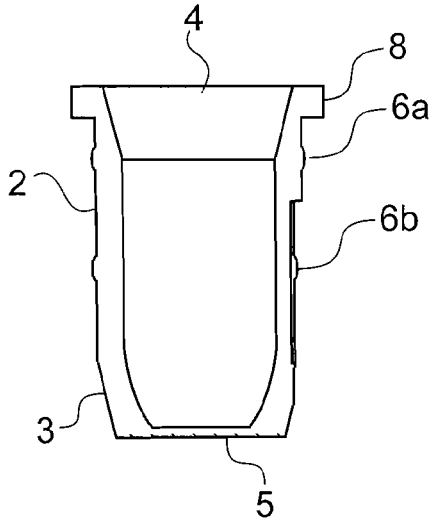
FIG. 4 is a cross section through line B-B of FIG. 3.
Figure 5:
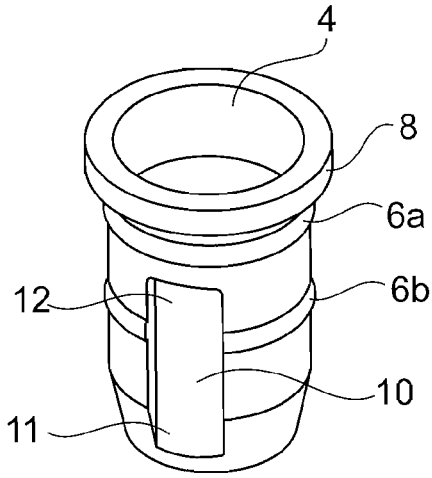
FIG. 5 is an isometric view of the wiper of FIG. 3.

For convenient reference only, the following description uses mascara packaging to describe aspects of the present invention. However, nothing in this description is intended to limit the present invention to mascara packaging. Referring to FIGS. 3-5, a novel wiper (1) according to the present invention comprises a hollow cylinder. The cylinder comprises at least two sections, an upper section (2) and a tapered section (3) located below the upper section. The upper section terminates in an upper orifice (4) and the lower section terminates in a lower orifice (5). The upper section supports an upper circumferential bead (6*a*) and a lower circumferential bead (6*b*). This is a departure from the prior art, which wipers generally have only one retention bead. As commonly practiced, the lower orifice is typically between 0.139 and 0.163 inches, although other sizes may be in use. The present invention is not limited to any particular range of lower orifice sizes and may be adjusted to accommodate changing requirements of brush-rod applicator assemblies. A flange (8) surrounds all or a substantial portion of the top of the upper section (2). As discussed above, when a conventional wiper is inserted into a mascara bottle, the subsequent escape of air from the bottle (as during filling) must occur through the wiper, via the lower orifice. The disadvantages of this were discussed above. To overcome these serious shortcomings of the prior art and to introduce new advantages, a novel wiper according to the present invention is provided with one or more means for allowing air inside the bottle to escape from the bottle without passing through the lower orifice.

To be effective, several embodiments of the present invention require a modified filling procedure, hereinafter referred to as the "raised wiper filling method". This is a departure from the prior art where wipers are fully inserted or fully seated in the bottle neck prior to filling. By "fully seated" we mean that the flange (8) is in contact with the top of the bottle neck finish. By "raised wiper" it is meant that the wiper is inserted only until the lower circumferential bead (6*b*) reaches a complimentary groove (7) of the neck, whence the lower bead fits securely into the complimentary neck groove (see FIG. 6). The lower bead is positioned so that when the lower bead is seated in the neck groove, the wiper will be in a raised up position. In this raised position a substantial portion of the upper section 2 remains outside the neck and the flange (8) is not seated on the top (31) of the neck. A tight fit exists between the bottle neck and that portion of the wiper that is inside the neck. Also, the fit of the lower bead in the neck groove is tight enough to hold the wiper in a raised position during transporting and filling. The contact between the bottle neck and the upper section and the fit of the lower bead in the neck groove form one or more airtight seals (A). In the drawings, "A" denotes all such airtight seals individually and collectively. Furthermore, by "airtight seal" it is meant that, during filling, air cannot pass through the airtight seal and out of the container as fast as the air is being displaced by product. The bottle is filled with the wiper in this raised position, which is unlike known filling methods.

To be effective, and in accordance with the present invention, the raised wiper filling method is used with a novel wiper that is provided with some means for interrupting the airtight seals (A) between the bottle neck and the upper section and the fit of the lower bead in the neck groove. When such means are provided, air displaced from the inside of the bottle may escape without passing through the lower orifice. Because the displaced air can escape around the sides of the wiper, the filler may use a fill tube that has a diameter virtually equal to the diameter of the lower orifice (5). If this is done, then an airtight seal (or nearly airtight) may be formed between the lower orifice of the wiper and the fill tube, but this does not matter because the displaced air is free to flow between the wiper and inner wall (31) of the neck.

One means for interrupting the airtight seal is a novel wiper having one or more grooves (10) recessed into the outer wall of the wiper. In one class of embodiments, a first portion of each of the one or more grooves is located on the outer wall of the wiper, below the level where the airtight seal (A) will occur when the wiper is placed in the raised wiper position. A second portion of each of the one or more grooves is located on the outer wall of the wiper, above the level where the airtight seal will occur when the wiper is placed in the raised wiper position.

For example, the first portion may be the lower end of the groove while the second portion is the upper end of the groove. The lower end may coincide with the bottom of the tapered section or it may lie above the bottom of the tapered section. The upper end of the groove may lie anywhere above the level of the airtight seal (A). For example, it may lie between the upper and lower beads (6*a*, 6*b*), as long as it is above the level of the airtight seal. Alternatively, the upper end of the groove may lie between the upper bead and the flange (8). In this case the upper circumferential bead will be interrupted, but this may cause no difficulty as long as the upper circumferential bead can still perform its retention function.

Figure 6:
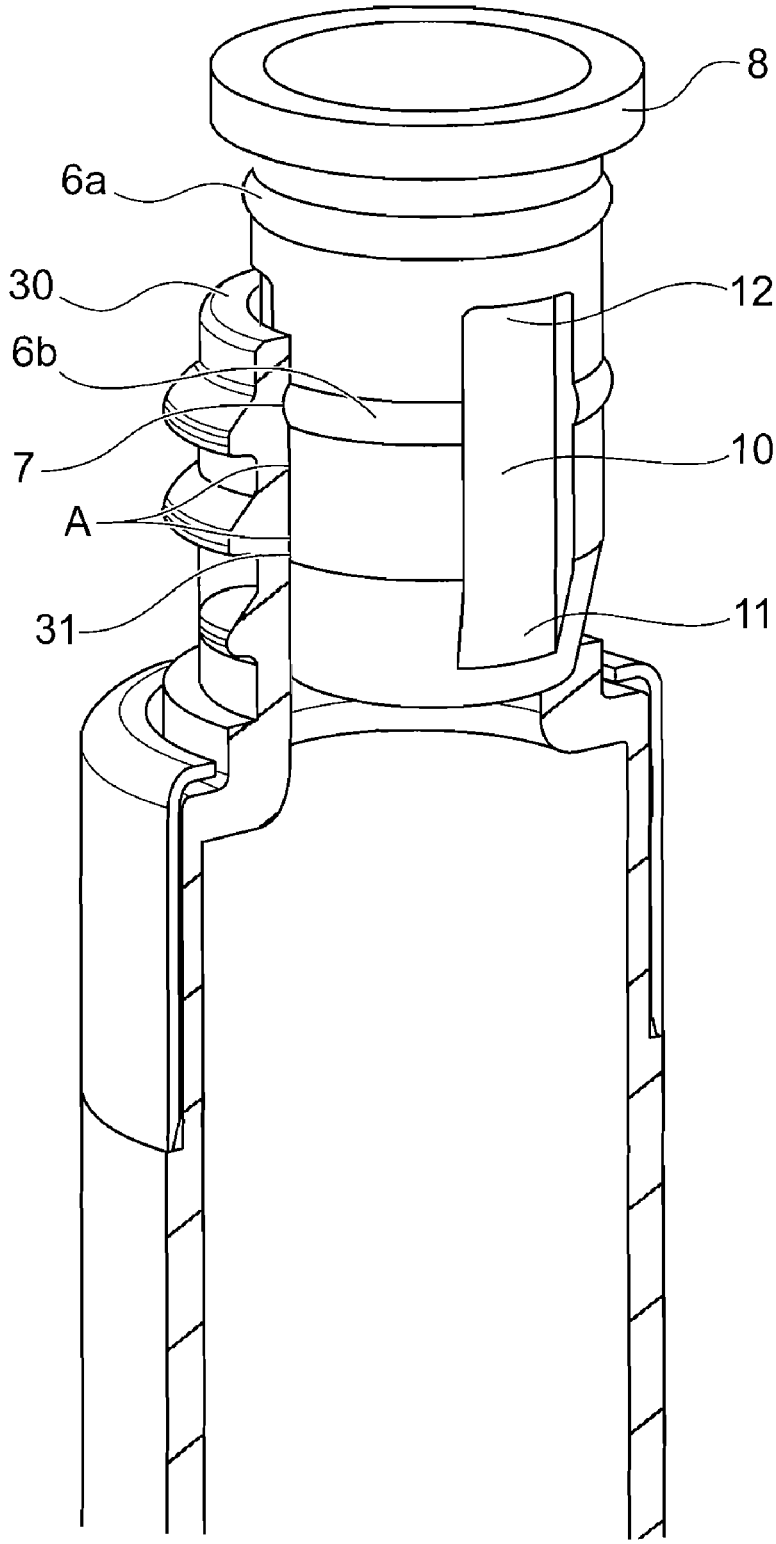
FIG. 6 is a wiper according to the present invention, located in a bottle neck in the raised wiper position, as described herein. A portion of the bottle neck has been removed to expose the wiper.

One embodiment is shown in FIGS. 5 and 6 wherein a groove (10) has a lower end (11) located on the outer wall of the tapered section, below the lower bead, and an upper end (12) located on the outer wall of the upper section between the upper and lower beads. With any of these alternatives, and with the modified filling procedure described above, air inside the bottle will be able to flow to the outside of the bottle without passing through the lower orifice of the wiper. As discussed, the advantage of this over the prior art is that the filling tube may be expanded to be as large as the lower orifice of the wiper, minimal clearance being needed. By "minimal clearance", we mean that the filling tube diameter may be increased to be about the size of the lower orifice, possibly even slightly larger than the lower orifice. The only requirement being that the fill tube should not dislodge the wiper from its raised up position wherein the lower circumferential bead (6*b*) is in the complimentary groove (7). As noted above, in a conventional filling procedure with conventional wiper, the filling tube orifice has a diameter of 0.119-0.143 inches (a radius of about 0.060-0.071 inches) and a clearance of 0.005 inches is maintained. If the fill tube radius is allowed to increase by 0.005 inches, as may be done with the present invention, then resistance to flow (which varies inversely as the fourth power of the tube radius) decreases by about 27% on average. However, if the retentive strength of the complimentary groove on the wiper is sufficient to hold the wiper in place, then the fill tube diameter may be even greater than the lower orifice diameter of the wiper, in which case, resistance to flow is further decreased.

Figure 7A:
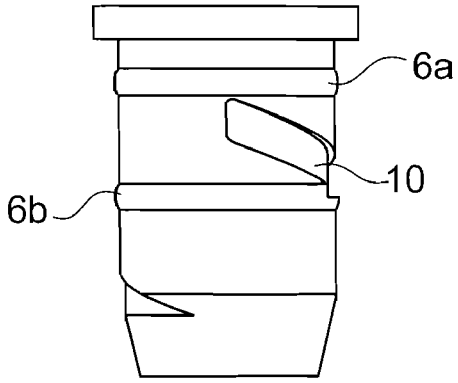
FIGS. 7A and 7B form an elevation view of a wiper according the to the present invention with a helical groove.
Figure 7B:
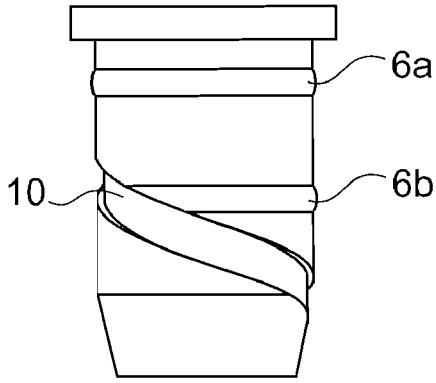
Figure 8:
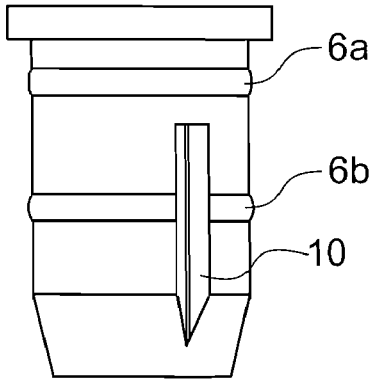
FIG. 8 is a elevation view of a wiper according the to the present invention with a notched groove.

Except as just described, the exact location of the upper and lower ends of the one or more grooves may be decided by concerns such as cost and ease of manufacture. As long as the upper and lower ends of the grooves are as defined above, the overall shape of the groove is virtually unlimited. The simplest groove may be straight and roughly parallel to the longitudinal axis of the wiper. Alternatively, a straight groove may be inclined at some angle to the longitudinal axis of the wiper, for example, it may be a helical groove (FIGS. 7A and 7B). The groove may have a flat or curved bottom or the groove may be an angled notch (FIG. 8).

In an alternative embodiment, some portion of the groove other than the lower end may lie below the level of the airtight seal (A) and some portion other than the upper end may lie above the level of the airtight seal. For example, the groove may be "U"-shaped, so that both the first and second ends of the "U" lie above or below the level of the airtight seal, while the turn of the "U" lies below or above the level of the airtight seal, respectively. Alternatively, the groove may have no well defined end at all. For example, such grooves may extend around the circumference of the wiper in a closed geometric shape, like a saw-tooth or sinusoidal pattern that closes on itself. As long as some portion of each groove is located within the two critical areas defined above, then the overall shape of the groove does not matter, because air will be able to escape from the bottle as the bottle is being filled, the air not having to pass through the lower orifice of the wiper.

Any suitable number of grooves as described may be provided on a single wiper. One critical factor is the total volume of all grooves on the wiper. This total volume should be sufficient to allow air to escape from the bottle during filling, at least as fast as the air is being displaced by product. Depending on the dimensions of a groove, more than one groove may or may not be necessary. Although, in practical terms there may be no reason why one suitably sized groove could not be placed on any known cosmetic bottle wiper. In many cases a person skilled in the art may determine the requisite number of grooves by routine experimentation.

The volume of a groove will be determined by its linear dimensions. If the groove is geometrically simple, then we may refer to each groove's length, width and depth or length and radius, as appropriate. For guidance, one may want limit the depth or radius of each groove to 25%-75% of the thickness of the wiper wall. However, this range may be exceeded if the integrity of the wiper will not be substantially compromised. The relevant dimensions may be readily determined by a person skilled in the art of wiper design and manufacture.

A wiper according to the present invention may be made of conventional materials such as natural or synthetic rubber, silicone and non-silicone elastomers and plastics. Some preferred materials are high and low density polyethylene and polypropylene. A wiper according to the present invention may be made by conventional molding methods and the present invention is not limited to any particular manufacturing method.

The present invention further encompasses a method of filling cosmetic packaging with a wiper, such as filling a mascara package. The first step in the novel method is to pre-assemble a bottle and wiper according to the present invention, so that the wiper is in the "raised position". This step comprises locating a wiper in the neck of an empty mascara container such that the lower circumferential bead (6*b*) fits into the neck groove (7), as in FIG. 6. This is done by first inserting the tapered section (3) of the wiper into the neck orifice and continuing to exert pressure on the wiper until the lower bead seats into the neck groove. When this is done, an airtight seal (A) is created between the wiper and inner wall (31) of the bottle neck, except where interruptions exist, as previously described.

A manufacturer-supplier may choose to provide the container and wiper already in this pre-assembled configuration. The pre-assembled configuration (an empty container fitted with a raised wiper of the present invention) is by itself novel. Alternatively, a supplier may separately provide the novel wiper of the present invention and a bottle, which would need to be pre-assembled prior to filling.

A next step in the method of filling is to insert a filling tube into the wiper upper orifice (4), through the wiper and down at least to the level of the lower orifice (5). When this is done, the filling tube forms an airtight seal against the lower orifice or so restricts the flow of air through the lower orifice as to effectively create an airtight seal. The next step is to fill the mascara bottle to a predetermined level. As this is done, air displaced within the bottle travels along one or more grooves from a level below the airtight seal (A) to a level above the airtight seal and out of the bottle. Next, the filling tube is removed from the bottle. Next, the wiper is urged into its final position, fully seated on the bottle with the flange (8) resting on the top (31) of the neck. The step of fully seating the wiper may be accomplished by applying pressure directly to the wiper. This step would require the filler to maintain a separate wiper seating operation, which the filler did not have to do previously. However, this seating operation is somewhat simpler than a seating operation of conventional wipers, because here, the filler does not have to locate the wipers in the bottle neck, that having been done already.

Thereafter, a closure may be applied to the bottle. When the wiper is fully seated with the flange resting on the top of the neck, the upper bead (6*a*) rests in the neck groove (7), in the conventional manner. The lower bead (6*b*), which formerly occupied the neck groove was displaced from the neck groove and comes to rest further down in the bottle. Depending on the exact dimensions and shape of the bottle and wiper, the lower bead may or may not contact the interior of the bottle when the wiper is fully seated.

Alternatively, indirect means may be used to fully seat the wiper. For example, a closure may be positioned over the wiper and pressure may be applied to the closure. For example, once positioned over the wiper the closure may be twisted to cause the closure threads to engage the bottle threads. It may be economically preferable to incorporate the step of seating the wipers into the capping operation. For example, a conventional mascara filling operation already has a capping operation in place and would not have to be modified to include a separate wiper seating operation. As the closure is twisted down onto the bottle, the closure forces the wiper down into its final, fully seated position, with the upper circumferential bead (6*a*) coming to rest in the neck groove (7). Once the wiper has been fully seated, the one or more wiper grooves (10) are sealed off from the ambient atmosphere by a seal formed between the flange and the top of the neck, so that no contamination of the product in the bottle may occur.

What is claimed is:

1. A cosmetic wiper comprising a hollow cylinder having an outer wall, the outer wall comprising:

an upper section terminating in an upper orifice;

a tapered section located below the upper section and terminating in an a lower orifice;

upper and lower circumferential beads located on the upper section; and a wiper groove recessed into the outer wall of the cylinder such that a first portion of the wiper groove is located below the lower circumferential bead and a second portion is located above the lower circumferential bead.

2. A cosmetic wiper according to claim 1 wherein the wiper groove comprises first and second ends.

3. A cosmetic wiper according to claim 2 wherein the first end is located below the lower circumferential bead and the second end is located above the lower circumferential bead.

4. A cosmetic wiper according to claim 3 wherein the wiper groove is straight and parallel to the longitudinal axis of the wiper.

5. A cosmetic wiper according to claim 3 wherein the wiper groove is helical.

6. A cosmetic wiper according to claim 2 wherein the wiper groove is U-shaped.

7. A cosmetic wiper according to claim 1 wherein the wiper groove has no end.

8. A cosmetic wiper according to claim 7 wherein the wiper groove is sinusoidal.

9. A cosmetic wiper according to claim 7 wherein the wiper groove is saw-toothed.

10. A cosmetic wiper according to claim 1 further comprising one or more additional wiper grooves recessed into the outer wall of the cylinder.

11. A cosmetic package with raised wiper comprising:

a bottle having a neck, the neck having a retention groove located on an inner wall of the neck;

a cosmetic wiper located in the neck of the bottle such that an airtight seal is formed between at least a portion of the wiper and the inner wall of the neck, the cosmetic wiper comprising:

a hollow cylinder having an outer wall, the outer wall comprising:

an upper section terminating in an upper orifice, a tapered section located below the upper section and terminating in a lower orifice, a lower circumferential bead located on the upper section and resting in the retention groove;

an upper circumferential bead;

a wiper groove recessed into the outer wall of the cylinder such that a first portion of the wiper groove is located below the airtight seal and a second portion is located above the airtight seal.

12. A method of filling a package that has a wiper, the method comprising displacing the air inside the package such that at least some of the displaced air flows out of the package without flowing through the wiper.

13. A method of filling a package that has a wiper, the method comprising:

displacing the air inside the package such that at least some of the displaced air flows out of the package without flowing through the wiper;

providing a pre-assembled package comprising:

a bottle having a neck, the neck having a top; and a raised wiper partially located in the neck of the bottle and partially raised above the top of the neck;

inserting a filling tube into the wiper;

filling the bottle via the filling tube;

removing the filling tube from the wiper.

14. The method of claim 13 wherein the step of providing a pre-assembled package includes forming an airtight seal between at least one portion of the wiper and at least one portion of the neck.

15. The method of claim 14 wherein the filling tube forms an airtight seal against the lower orifice.

16. The method of claim 15 wherein, after the filling tube is removed from the wiper, the wiper is urged further into the neck.

17. The method of claim 16 wherein the step of urging the wiper is accomplished by applying pressure directly to the wiper.

18. The method of claim 16 wherein the step of urging the wiper is accomplished by applying pressure indirectly to the wiper.

19. The method of claim 18 wherein the a closure is positioned over the wiper and pressure is applied to the closure.

* * * * *